US008928444B2

(12) United States Patent
Kido et al.

(10) Patent No.: US 8,928,444 B2
(45) Date of Patent: Jan. 6, 2015

(54) COOLING STRUCTURE FOR MAGNET-EQUIPPED REACTOR

(75) Inventors: Naohiro Kido, Shiga (JP); Toshiyuki Maeda, Shiga (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 13/511,935

(22) PCT Filed: Nov. 25, 2010

(86) PCT No.: PCT/JP2010/006889
§ 371 (c)(1),
(2), (4) Date: May 24, 2012

(87) PCT Pub. No.: WO2011/065001
PCT Pub. Date: Jun. 3, 2011

(65) Prior Publication Data

US 2012/0293290 A1 Nov. 22, 2012

(30) Foreign Application Priority Data

Nov. 25, 2009 (JP) ..... 2009-267994

(51) Int. Cl.
*H01F 27/08* (2006.01)
*H01F 21/00* (2006.01)
*H01F 27/10* (2006.01)

(52) U.S. Cl.
CPC ..... *H01F 27/10* (2013.01)
USPC ..... 336/60; 336/55; 336/61; 336/110

(58) Field of Classification Search
CPC ..... H01F 27/22; H01F 27/025; H01F 27/085; H01F 27/12; H01F 37/00
USPC ..... 336/55, 56, 57, 58, 59, 60, 61, 110, 179
See application file for complete search history.

(56) References Cited

U.S. PATENT DOCUMENTS

| | | | | | |
|---|---|---|---|---|---|
| 2,615,075 | A | * | 10/1952 | Paluev | 165/47 |
| 3,264,589 | A | * | 8/1966 | Dutton | 336/57 |
| 4,627,407 | A | * | 12/1986 | Betz | 123/634 |
| 6,545,582 | B2 | * | 4/2003 | Sato | 336/110 |
| 6,639,499 | B2 | * | 10/2003 | Okita et al. | 336/110 |
| 6,710,693 | B2 | * | 3/2004 | Matsumoto et al. | 336/110 |
| 2009/0206973 | A1 | * | 8/2009 | Yabumi et al. | 336/110 |

FOREIGN PATENT DOCUMENTS

| | | | | |
|---|---|---|---|---|
| JP | 54-66134 | U | | 5/1979 |
| JP | 11-23081 | A | | 1/1999 |
| JP | 11-72256 | A | | 3/1999 |
| JP | 2003-297649 | A | | 10/2003 |
| JP | 2003297649 | A | * | 10/2003 |
| JP | 2003-338414 | A | | 11/2003 |
| JP | 2005-303212 | A | | 10/2005 |
| JP | 2005303212 | A | * | 10/2005 |
| JP | 2005-317623 | A | | 11/2005 |

(Continued)

*Primary Examiner* — Elvin G Enad
*Assistant Examiner* — Kazi Hossain
(74) *Attorney, Agent, or Firm* — Birch, Stewart, Kolasch & Birch, LLP

(57) ABSTRACT

A cooling structure for a magnet-equipped reactor includes: a magnet-equipped reactor (60) having a core (61) around which a coil (70) is wound, and a magnet (75) arranged to contact the core (61); and a cooling member (51) arranged to contact the magnet (75) of the magnet-equipped reactor (60) to cool the magnet (75).

6 Claims, 7 Drawing Sheets

(56) References Cited

FOREIGN PATENT DOCUMENTS

| | | | | |
|---|---|---|---|---|
| JP | 2006-319176 | A | | 11/2006 |
| JP | 2008-218699 | A | | 9/2008 |
| JP | 2008218699 | A | * | 9/2008 |

* cited by examiner

COOLING STRUCTURE FOR MAGNET-EQUIPPED REACTOR

TECHNICAL FIELD

The present invention relates to a cooling structure for a magnet-equipped reactor, including a core around which a coil is wound, and a magnet in contact with the core.

BACKGROUND ART

Reactors have been used in power supply circuits for compressors of refrigeration apparatuses to improve inverter's power factor. A known example of the reactors of this type is a so-called magnet-equipped reactor including a permanent magnet, and a downsized core structure.

A magnet-equipped reactor disclosed by Patent Document 1 includes a T-shaped core and a C-shaped core, and a coil is wound around a leg of the T-shaped core. A pair of permanent magnets are arranged between a bottom of the T-shaped core and legs of the C-shaped core with magnetic gaps interposed therebetween. Thus, the magnet-equipped reactor can obtain desired magnetic bias, and can obtain desired L-I characteristics.

CITATION LIST

Patent Document

[Patent Document 1] Japanese Patent Publication No. 2003-338414

SUMMARY OF THE INVENTION

Technical Problem

In the above-described magnet-equipped reactor, the coil wound around the core generates heat, thereby increasing temperature of the permanent magnets in contact with the core. When the temperature of the magnet increases, a magnetizing force of the magnet (a magnetic force generated by the magnet) decreases, and the desired magnetic bias cannot be obtained.

In view of the foregoing, the present invention has been achieved. The invention is concerned with alleviating the reduction of the magnetizing force of the magnet-equipped reactor caused by the increase in temperature of the magnet.

Solution to the Problem

A first aspect of the invention is directed to a cooling structure for a magnet-equipped reactor. The cooling structure includes: a magnet-equipped reactor (60) having a core (61) around which a coil (70) is wound, and a magnet (75) arranged to contact the core (61); and a cooling member (51) which contacts the magnet (75) of the magnet-equipped reactor (60) to cool the magnet (75).

According to the first aspect of the invention, the magnet (75) is provided to contact with the core (61). Thus, when the coil (70) is energized and generates heat, the heat is transferred to the magnet (75) through the core (61). According to the present invention, the cooling member (51) is provided to cool the magnet (75). Specifically, the cooling member (51) is thermally in contact with the magnet (75), and absorbs the heat of the magnet (75). Thus, the magnet (75) is cooled, and the temperature of the magnet (75) is reduced.

In a second aspect of the invention related to the first aspect of the invention, the magnet (75) is fitted in a groove (55) formed in the cooling member (51).

According to the second aspect of the invention, the groove (55) is formed in the cooling member (51). The magnet (75) is fitted in the groove (55). This relatively increases a contact area between the magnet (75) and the cooling member (51). Thus, the magnet (75) can be cooled more effectively.

In a third aspect of the invention related to the first or second aspect of the invention, the cooling member (51) contacts both of the magnet (75) and the coil (70) wound around the core (61) to cool both of the magnet (75) and the coil (70).

According to the third aspect of the invention, the cooling member (51) cools both of the magnet (75) and the coil (70). This can reduce heat generation by the coil (70), and can reduce heat input from the coil (70) to the magnet (75). Thus, the temperature of the magnet (75) is further reduced.

In a fourth aspect of the invention related to any one of the first to third aspects of the invention, the cooling member (51) includes a refrigerant passage (58) through which a refrigerant flows, and a heat transfer part (53, 54, 56) arranged to contact the magnet (75) to exchange heat with the refrigerant in the refrigerant passage (58).

According to the fourth aspect of the invention, the cooling member (51) includes the refrigerant passage (58) and the heat transfer part (53, 54, 56). The refrigerant for cooling the magnet (75) flows in the refrigerant passage (58). The heat transfer part (53, 54, 56) is thermally in contact with the magnet (75). Thus, the heat of the magnet (75) is transferred to the refrigerant flowing in the refrigerant passage (58) through the heat transfer part (53, 54, 56). Thus, the magnet (75) is cooled, and the temperature of the magnet (75) is reduced.

In a fifth aspect of the invention related to the fourth aspect of the invention, a temperature of the refrigerant flowing through the refrigerant passage (58) is lower than a dew point temperature of air around the cooling member (51).

According to the fifth aspect of the invention, the temperature of the refrigerant in the refrigerant passage (58) is lower than the dew point temperature of the air around the cooling member (51). Thus, the cooling member (51) can cool the magnet (75) more effectively. When the temperature of the refrigerant in the refrigerant passage (58) is reduced, a temperature of terminals to which a winding start and a winding end of the coil (70) are connected is reduced, and dew condensation and a short circuit may occur around the terminals. According to the present invention, however, the temperature of the coil (70) is high. Therefore, even when the temperature of the refrigerant passage (58) is reduced, a surface temperature of the terminals connected to the coil (70) is not significantly reduced. Thus, the magnet (75) can be cooled, while preventing the dew condensation at the terminals.

In a sixth aspect of the invention related to the fourth or fifth aspect of the invention, the refrigerant passage (58) is formed in a refrigerant pipe (52) buried in the heat transfer part (53, 54, 56).

According to the sixth aspect of the invention, the refrigerant pipe (52) is buried in the heat transfer part (53, 54, 56), and the refrigerant passage (58) is formed in the refrigerant pipe (52). The heat of the magnet (75) is transferred to the refrigerant flowing in the refrigerant passage (58) through the heat transfer part (53, 54, 56) and the refrigerant pipe (52).

In a seventh aspect of the invention related to the fourth or fifth aspect of the invention, multiple ones of the refrigerant passage (58) are formed in the heat transfer part (53, 54, 56).

According to the seventh aspect of the invention, multiple ones of the refrigerant passage (58) are formed in the heat transfer part (53, 54, 56), and the refrigerant flows in the refrigerant passages (58). The heat of the magnet (75) is transferred to the refrigerant flowing in the refrigerant passages (58) through the heat transfer part (53, 54, 56).

Advantages of the Invention

According to the present invention, the magnet (75) of the magnet-equipped reactor (60) is cooled by the cooling member (51). This can reduce the increase in temperature of the magnet (75), and can prevent the reduction of the magnetizing force of the magnet (75). Thus, the magnet-equipped reactor (60) can obtain desired magnetic bias, and can obtain desired L-I characteristics.

Reducing the increase in temperature of the magnet (75) can reduce resistance of the magnet (75) to heat. Specifically, the magnet-equipped reactor (60) of the present invention does not require a high heat-resistant magnet. This can reduce costs of the magnet-equipped reactor (60).

In particular, according to the second aspect of the invention, the magnet (75) is fitted in the groove (55) of the cooling member (51). This can increase a contact area between the cooling member (51) and the magnet (75), and can increase heat transfer efficiency. Thus, the magnet (75) can effectively be cooled.

According to the third aspect of the invention, the cooling member (51) cools both of the magnet (75) and the coil (70). This can reduce the heat generation of the coil (70). Thus, the magnet (75) can be cooled more effectively.

According to the fourth aspect of the invention, the magnet (75) can be cooled by the refrigerant flowing through the refrigerant passage (58). This allows easy temperature control of the magnet (75), and the magnet (75) can effectively be cooled. Thus, the reduction of the magnetizing force of the magnet (75) can be prevented, and costs of the magnet (75) can be reduced.

According to the fifth aspect of the invention, the temperature of the refrigerant flowing through the refrigerant passage (58) is lower than the dew point temperature of the ambient air. Thus, the magnet (75) can be cooled more effectively. Even when the temperature of the refrigerant is reduced, the surface temperature of the terminals connected to the coil (70) is not significantly reduced because the coil (70) generates heat. This can prevent dew condensation at the terminals, and can prevent a short circuit at the terminals.

According to the sixth aspect of the invention, the refrigerant passage (58) is formed in the refrigerant pipe (52) buried in the heat transfer part (53, 54, 56). When the refrigerant pipe (52) is buried in the heat transfer part (53, 54, 56), resistance of the refrigerant pipe (52) to pressure can be ensured, and the refrigerant pipe (52) can be thinned down.

According to the seventh aspect of the invention, a plurality of refrigerant passages (58) are formed in the heat transfer part (53, 54, 56), and the heat transferred from the magnet (75) to the heat transfer part (53, 54, 56) can directly be transferred to the refrigerant flowing through the refrigerant passages (58). Thus, the magnet (75) can be cooled more effectively.

DESCRIPTION OF EMBODIMENTS

Embodiments of the present invention will be described in detail with reference to the drawings.

The present embodiment is directed to an air conditioner (10) constituted of a refrigeration apparatus for performing a vapor compression refrigeration cycle.

[First Embodiment of the Invention]

Figure 1:
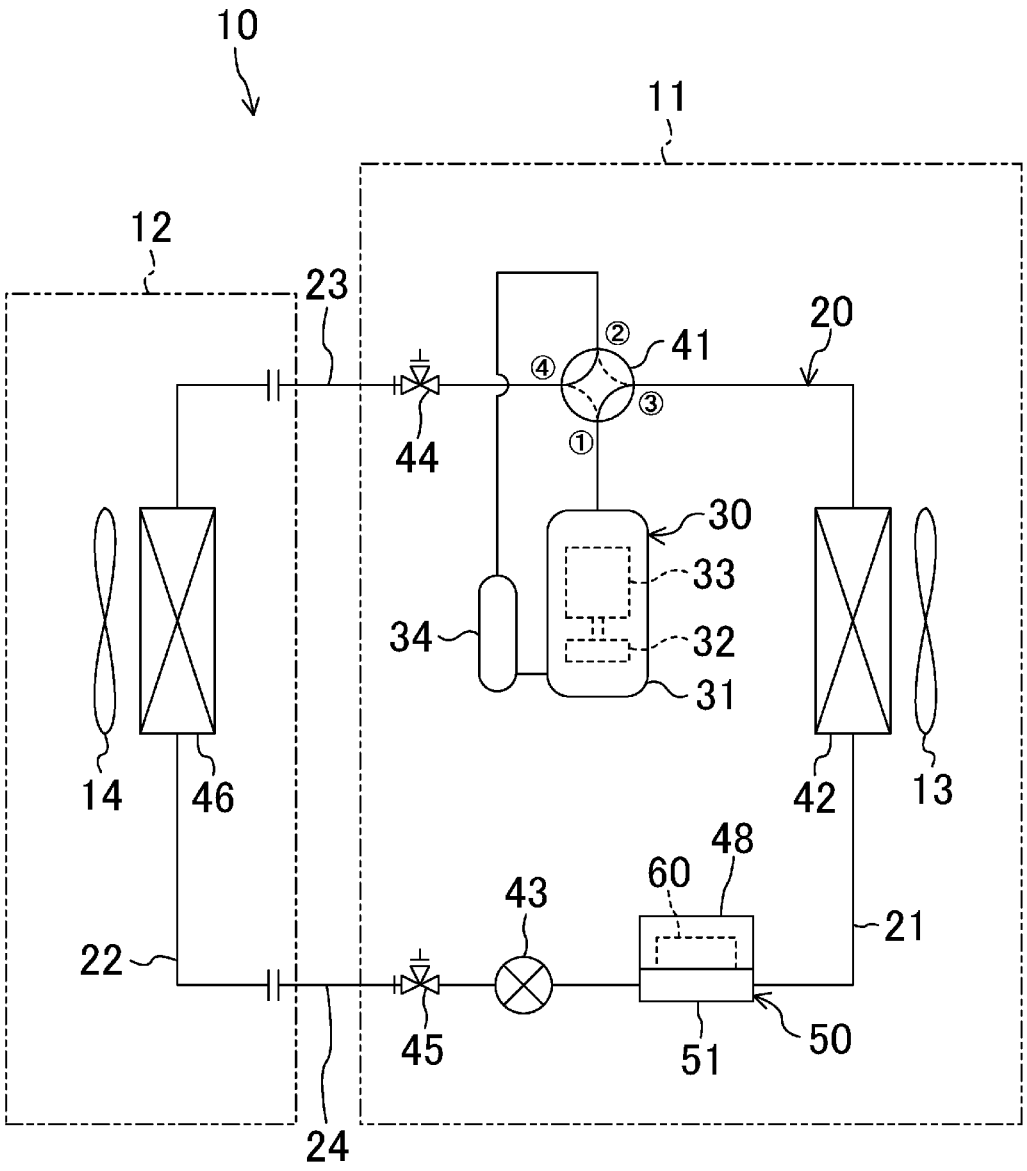
FIG. 1 schematically shows a general structure of an air conditioner according to a first embodiment.

As shown in FIG. 1, an air conditioner (10) of a first embodiment includes an outdoor unit (11) placed outside a room and an indoor unit (12) placed inside the room. The outdoor unit (11) contains an outdoor circuit (21). The indoor unit (12) contains an indoor circuit (22). In the air conditioner (10), a refrigerant circuit (20) is formed by connecting the outdoor circuit (21) and the indoor circuit (22) with a pair of communication pipes (23, 24).

The outdoor circuit (21) includes a compressor (30), a four-way valve (41), a cooling unit (50), and an expansion valve (43). A cooling member (51) will be described later. A discharge end of the compressor (30) is connected to a first port of the four-way valve (41), and a suction end of the compressor (30) is connected to a second port of the four-way valve (41) through an accumulator (34). A third port of the four-way valve (41) is connected to an end of an outdoor heat exchanger (42), and a fourth port is connected to a gas stop valve (44). The other end of the outdoor heat exchanger (42) is connected to an end of the expansion valve (43) through the cooling unit (50). The other end of the expansion valve (43) is connected to a liquid stop valve (45).

The indoor circuit (22) includes an indoor heat exchanger (46). A gas end of the indoor circuit (22) is connected to the gas stop valve (44) through a gas communication pipe (23), and a liquid end of the indoor circuit (22) is connected to the liquid stop valve (45) through a liquid communication pipe (24).

The compressor (30) is a so-called hermetic compressor. Specifically, the compressor (30) includes a compression mechanism (32) for compressing a refrigerant, an electric motor (33) for driving the compression mechanism (32) to rotate, and a casing (31) containing the compression mechanism and the electric motor. The four-way valve (41) is configured to be able to switch between a first state (indicated by a solid line in FIG. 1) in which the first port and the third port communicate with each other, and the second port and the fourth port communicate with each other, and a second state (indicated by a broken line in FIG. 1) in which the first port and the fourth port communicate with each other, and the second port and the third port communicate with each other. The expansion valve (43) is a motor-operated expansion valve whose degree of opening is variable by driving a valve element by a pulse motor.

The outdoor heat exchanger (42) and the indoor heat exchanger (46) are fin-and-tube heat exchangers for exchanging heat between the refrigerant and the air. Outdoor air and the refrigerant exchange heat in the outdoor heat exchanger (42). The outdoor unit (11) includes an outdoor fan (13) for sending the outdoor air to the outdoor heat exchanger (42). Indoor air and the refrigerant exchange heat in the indoor heat exchanger (46). The indoor unit (12) includes an indoor fan (14) for sending the indoor air to the indoor heat exchanger (46).

The outdoor unit (11) includes an inverter apparatus (48) as a power supply. The inverter apparatus (48) is configured to convert a frequency of alternating current supplied from a commercial power supply to a value commanded by a controller, and to supply the alternating current with the converted frequency to the electric motor (33) of the compressor (30). The inverter apparatus (48) is provided with a magnet-equipped reactor (60). The inverter apparatus (48) is provided with a power device (not shown), such as an insulated gate bipolar transistor (IGBT).

Figure 2:
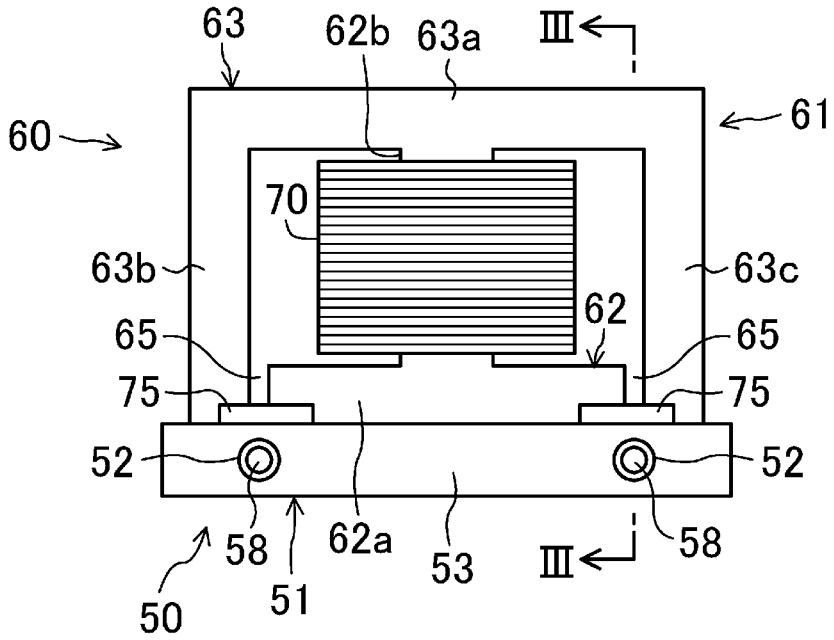
FIG. 2 is a front view of a cooling unit according to the first embodiment.
Figure 3:
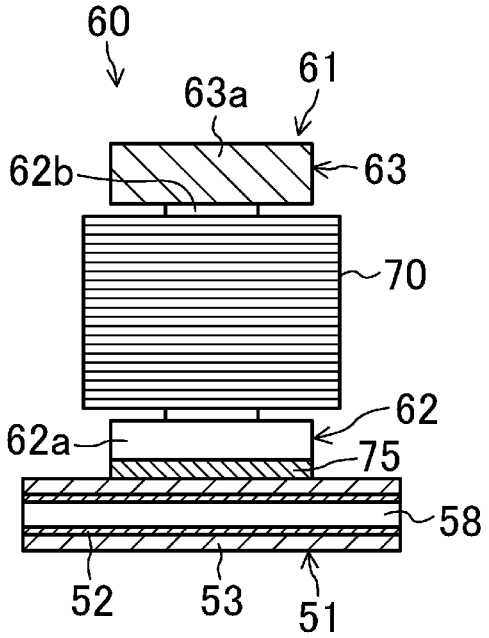
FIG. 3 is a cross-sectional view taken along the line in FIG. 2.

A cooling member (51) and the magnet-equipped reactor (60) are integrally combined to constitute the cooling unit (50). The cooling unit (50) (i.e., a cooling structure for a magnet-equipped reactor) will be described in detail with reference to FIGS. 2 and 3.

The magnet-equipped reactor (60) includes a core (61), a coil (70) wound around the core (61), and a magnet (75) which is a permanent magnet. The core (61) includes a T-shaped core (62) and a C-shaped core (63) which are integrally coupled to each other.

The T-shaped core (62) is arranged in the shape of inverted T when viewed in cross-section. The T-shaped core (62) includes a bottom portion (62*a*) extending in a horizontal direction, and a leg portion (62*b*) extending perpendicular from a center of the bottom portion (62*a*). The coil (70) is wound around the leg portion (62*b*) of the T-shaped core (62). A winding start and a winding end of the coil (70) are positioned near an upper end of the leg portion (62*b*), where terminals (not shown) are arranged to be connected to ends of the coil (70), respectively. Specifically, the terminals of the coil (70) are positioned at one of longitudinal ends of the leg portion (62*b*) farther from the cooling unit (51). This can prevent cooling of the vicinity of the terminals by the cooling member (51), thereby effectively preventing dew condensation on surfaces of the terminals. The terminals are preferably covered with an insulating material to surely prevent the dew condensation on the surfaces of the terminals.

The C-shaped core (63) is in the shape of C or U which is opened downward when viewed in cross-section. The C-shaped core (63) is arranged to surround the T-shaped core (62). The C-shaped core (63) includes an upper wall portion (63*a*) which extends horizontally and is coupled to the upper end of the leg portion (62*b*) of the T-shaped core (62), and a pair of side wall portions (63*b*, 63*c*) extending downward from ends of the upper wall portion (63*a*), respectively.

Gaps (magnetic gaps (65, 65)) are provided between ends of the bottom portion (62*a*) of the T-shaped core (62) and inner surfaces of lower ends of the side wall portions (63*b*, 63*c*) of the C-shaped core (63), respectively. A pair of magnets (75, 75) are provided near the gaps (65, 65) so that the magnets can reach the ends of the bottom portion (62*a*) of the T-shaped core (62) and the side wall portions (63*b*, 63*c*) of the C-shaped core (63), respectively. Specifically, each of the magnets (75, 75) is arranged to contact both of the T-shaped core (62) and the C-shaped core (63).

The cooling member (51) includes a plurality of refrigerant pipes (52) through which the refrigerant flows, and a lower jacket (53) surrounding the refrigerant pipes (52). Each of the refrigerant pipes (52) is buried in the lower jacket (53), and penetrates the lower jacket (53). Each of the refrigerant pipes (52) is connected in parallel between the outdoor heat exchanger (42) and the expansion valve (43) of the outdoor circuit (21). Specifically, a refrigerant passage (58) which is connected to the refrigerant circuit (20) and in which the refrigerant flows is formed in each of the refrigerant pipes (52). In the first embodiment, the refrigerant pipes (52) are provided immediately below the magnets (75, 75), respectively. The refrigerant pipe (52) is made of a copper pipe, for example, but may be made of other metals as long as they have high heat transfer property.

The lower jacket (53) is made of metal having high thermal conductivity, such as aluminum, and constitutes a heat transfer part. The lower jacket (53) supports the magnet-equipped reactor (60) from below. Specifically, the lower jacket (53) is in the shape of a slightly thick, vertically flat plate. The pair of magnets (75, 75) are arranged on an upper surface of the lower jacket (53). The bottom portion (62*a*) of the T-shaped core (62), and lower end faces of the side wall portions (63*b*, 63*c*) of the C-shaped core (63) are also in contact with the upper surface of the lower jacket (53).

In the cooling unit (50) configured as described above, the cooling member (51) can cool the magnets (75, 75) and the core (61) of the magnet-equipped reactor (60).

—Working Mechanism—

The air conditioner (10) of the first embodiment selectively performs cooling operation and heating operation.

<Cooling Operation>

Cooling operation will be described below. In the air conditioner (10) performing the cooling operation, the four-way valve (41) is in the first state (indicated by a solid line in FIG. 1), and the outdoor fan (13) and the indoor fan (13) are operated. In the cooling operation, the outdoor heat exchanger (42) and the indoor heat exchanger (46) of the refrigerant circuit (20) function as a condenser and an evaporator, respectively, to perform a refrigeration cycle. In the cooling operation, the cooling unit (50) of the refrigerant circuit (20) is located between the outdoor heat exchanger (42) as the condenser and the expansion valve (43). Specifically, the refrigerant passages (58) in the refrigerant pipes (52) are connected to a high pressure liquid line between the condenser (the outdoor heat exchanger (42)) and the expansion valve (43) in the cooling operation.

In the cooling operation, the refrigerant discharged from the compressor (30) of the refrigerant circuit (20) flows into the outdoor heat exchanger (42) through the four-way valve (41), and dissipates heat to the outdoor air to condense. The refrigerant condensed in the outdoor heat exchanger (42) flows into the refrigerant pipe (52) of the cooling member (51) of the cooling unit (50).

In the magnet-equipped reactor (60), the coil (70) generates heat when energized. The heat of the coil (70) is transferred to the magnet (75) through the T-shaped core (62) and the C-shaped core (63). In the refrigerant pipes (52) of the cooling member (51), the refrigerant condensed in the outdoor heat exchanger (42) flows. Thus, the heat transferred to the magnet (75) is absorbed by the refrigerant through the lower jacket (53) and the refrigerant pipes (52). As a result, the magnet (75) is cooled, thereby reducing increase in temperature of the magnet (75). Since the lower jacket (53) is also in contact with the T-shaped core (62) and the C-shaped core (63), the cores (62, 63) are also cooled by the cooling member (51).

The refrigerant flowing out of the refrigerant pipes (52) of the cooling unit (50) is decompressed when passing through the expansion valve (43), flows into the indoor heat exchanger (46), and then absorbs heat from the indoor air to evaporate. The indoor unit (12) feeds the air cooled in the indoor heat exchanger (46) to the inside of the room. The refrigerant evaporated in the indoor heat exchanger (46) sequentially passes through the four-way valve (41) and the accumulator (34), and then sucked and compressed in the compressor (30).

<Heating Operation>

Heating operation will be described below. In the air conditioner (10) performing the heating operation, the four-way valve (41) is in the second state (indicated by a broken line in FIG. 1), and the outdoor fan (13) and the indoor fan (14) are operated. In the heating operation, the indoor heat exchanger (46) and the outdoor heat exchanger (42) of the refrigerant circuit (20) function as a condenser and an evaporator, respectively, to perform a refrigeration cycle. In the heating operation, the cooling unit (50) of the refrigerant circuit (20) is located between the expansion valve (43) and the outdoor heat exchanger (42) as the evaporator. Thus, the refrigerant passages (58) in the refrigerant pipes (52) are connected to a low pressure liquid line between the expansion valve (43) and the evaporator (the outdoor heat exchanger (42)) in the heating operation. In the heating operation, a temperature of the refrigerant flowing through the refrigerant passages (58) is controlled to be lower than a dew point temperature of air around the cooling unit (50). Specifically, the temperature of the refrigerant is kept lower than the dew point temperature by controlling the degree of opening of the expansion valve (43), for example.

In the heating operation, the refrigerant discharged from the compressor (30) of the refrigerant circuit (20) flows into the indoor heat exchanger (46) through the four-way valve (41), and dissipates heat to the indoor air to condense. The indoor unit (12) feeds the air heated in the indoor heat exchanger (46) to the inside of the room. The refrigerant condensed in the indoor heat exchanger (46) is decompressed when passing through the expansion valve (43), and then flows into the refrigerant pipes (52) of the cooling unit (50).

In the magnet-equipped reactor (60), the coil (70) generates heat when energized. The heat of the coil (70) is transferred to the magnet (75) through the T-shaped core (62) and the C-shaped core (63). In the refrigerant pipe (52) of the cooling member (51), the refrigerant which passed through the expansion valve (43) flows. Thus, the heat transferred to the magnet (75) is absorbed by the refrigerant through the lower jacket (53) and the refrigerant pipes (52). As a result, the magnet (75) is cooled, thereby reducing the increase in temperature of the magnet (75). Since the lower jacket (53) is also in contact with the T-shaped core (62) and the C-shaped core (63), the cores (62, 63) are also cooled by the cooling member (51).

-Advantages of First Embodiment-

According to the first embodiment, the magnets (75, 75) of the magnet-equipped reactor (60) are cooled by the cooling member (51). This can reduce the increase in temperature of the magnets (75, 75), and can prevent reduction of the magnetizing force of the magnets (75, 75). Thus, the magnet-equipped reactor (60) can obtain desired magnetic bias, and can obtain desired L-I characteristics.

Reducing the increase in temperature of the magnets (75, 75) can reduce resistance of the magnets (75, 75) to heat. Specifically, the magnet-equipped reactor (60) of the first embodiment does not require a high heat-resistant magnet. This can reduce costs of the magnet-equipped reactor (60).

In the first embodiment, the lower jacket (53) and the core (61) of the cooling member (51) are brought into contact to simultaneously cool the magnets (75, 75) and the core (61). Thus, heat input from the core (61) to the magnets (75, 75) can be reduced, and the magnets (75, 75) can be cooled more effectively.

In the first embodiment, the refrigerant pipes (52) are buried in the lower jacket (53), and the refrigerant passages (58) are formed in the refrigerant pipe (52). Thus, resistance of the refrigerant pipes (52) to pressure can be ensured, and the refrigerant pipes (52) can be thinned down.

In the first embodiment, the temperature of the refrigerant flowing through the refrigerant passages (58) is controlled to be lower than a dew point temperature of the ambient air in the heating operation. This increases cooling capability of the cooling member (51) to cool the core (61) and the magnets (75, 75). Even when the temperature of the refrigerant is reduced, a surface temperature of the terminals connected to the coil (70) is not significantly reduced. This is because heat quantity of the coil (70) is large, and the terminals are located relatively away from the cooling member (51). Thus, dew condensation on the surfaces of the terminals of the coil (70) can be prevented, and a short circuit at the terminals can be prevented.

<Alternative of First Embodiment>

The first embodiment may be modified in the following manner

—First Alternative—

Figure 4:
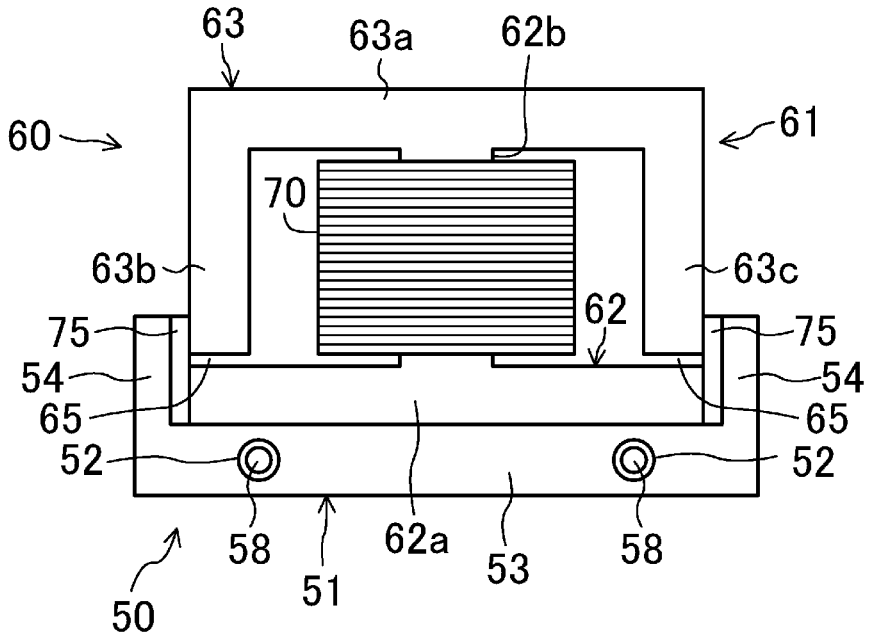
FIG. 4 is a front view of a cooling unit according to a first alternative of the first embodiment.

In a magnet-equipped reactor (60) according to a first alternative shown in FIG. 4, the bottom portion (62*a*) of the T-shaped core (62) is longer than that of the first embodiment in a lengthwise direction (a horizontal direction in FIG. 4), and the side wall portions (63*b*) of the C-shaped core (63) are shorter than those of the first embodiment in a vertical direction. In the magnet-equipped reactor (60) of the first alternative, gaps (65, 65) are formed between upper surfaces of ends of the bottom portion (62*a*) of the T-shaped core (62) and lower end faces of the side wall portions (63*b*) of the C-shaped core (63), respectively. Magnets (75, 75) of the first alternative stand upright outside the core (61) such that the magnets contact lower ends of the side wall portions (63*b*) of the C-shaped core (63), and end faces of the bottom portion (62*a*) of the T-shaped core (62), respectively. In the first alternative, the entire part of the bottom portion (62*a*) of the T-shaped core (62) is in contact with the lower jacket (53).

A cooling member (51) of the first alternative includes a pair of side jackets (54, 54) connected to the lower jacket (53). Each of the side jackets (54) extends upward from an end of the lower jacket (53) to cover an outer surface of the magnet (75, 75). The side jackets (54, 54) are made of metal having high thermal conductivity, such as aluminum, and constitute a heat transfer part, like the lower jacket (53).

In the first alternative, heat of each of the magnets (75, 75) is sequentially transferred to the side jacket (54, 54), the lower jacket (53), and the refrigerant pipe (52), and is absorbed by the refrigerant flowing through the refrigerant pipe (52). This can reduce the increase in temperature of the magnets (75, 75), and can alleviate reduction of the magnetizing force of the magnets (75, 75). In the first alternative, the entire part of the bottom portion (62*a*) of the T-shaped core (62) can be cooled by the lower jacket (53).

—Second Alternative—

Figure 5:
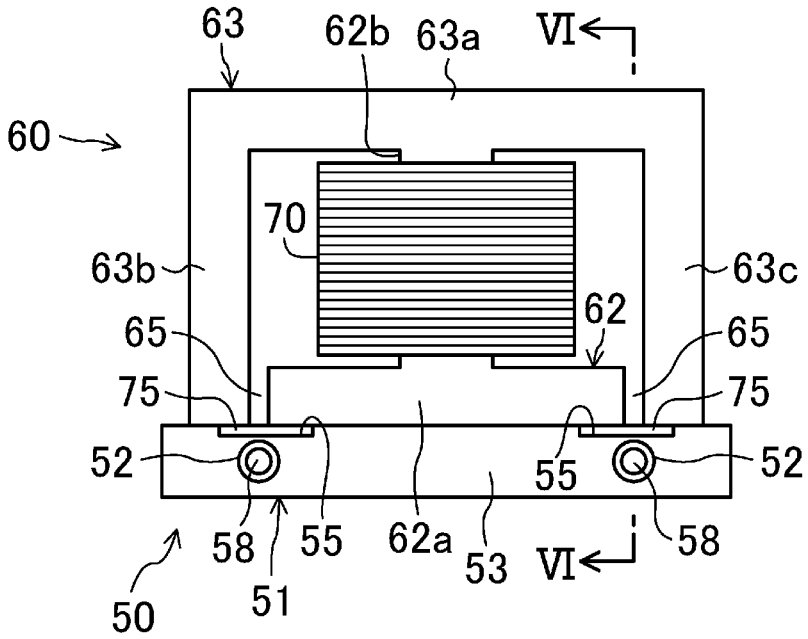
FIG. 5 is a front view of a cooling unit according to a second alternative of the first embodiment.
Figure 6:
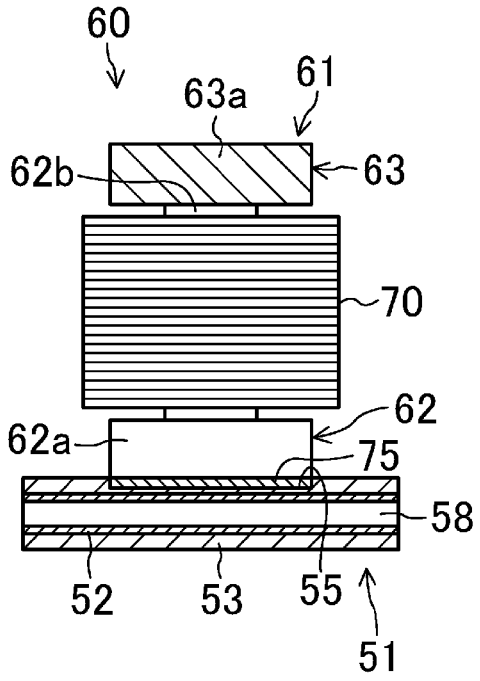
FIG. 6 is a cross-sectional view taken along the line VI-VI in FIG. 5.

According to a second alternative shown in FIGS. 5 and 6, a pair of grooves (55, 55) are formed in the lower jacket (53). In the second alternative, the magnets (75, 75) are fitted in the grooves (55, 55), respectively. The refrigerant pipes (52, 52) are provided immediately below the grooves (55, 55), respectively.

In the second alternative, the magnets (75, 75) are provided in the grooves (55, 55) in the lower jacket (53). This can increase a contact area between the magnets (75, 75) and the lower jacket (53), and can increase heat transfer efficiency. Thus, the magnets (75, 75) can be cooled more effectively.

—Third Alternative—

Figure 7:
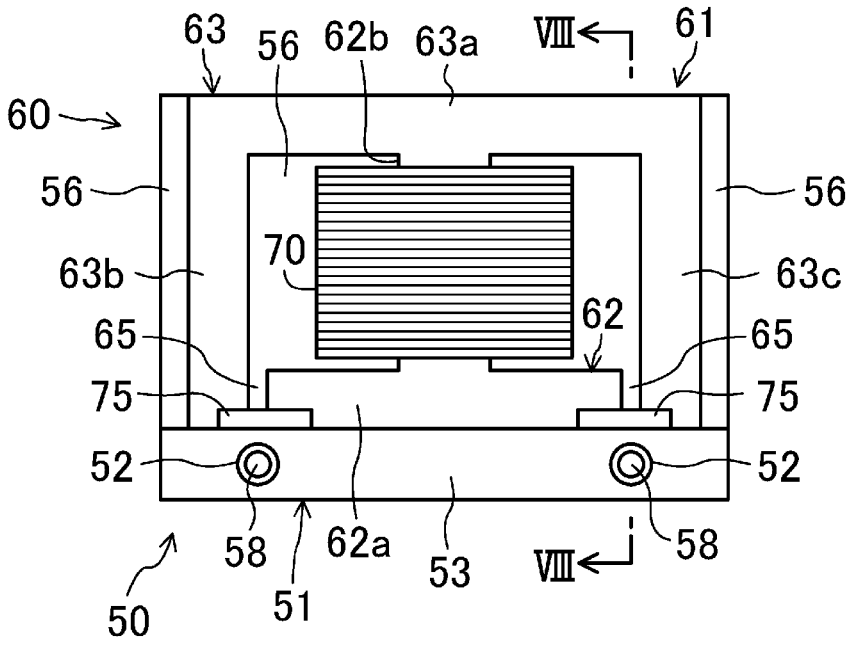
FIG. 7 is a front view of a cooling unit according to a third alternative of the first embodiment.
Figure 8:
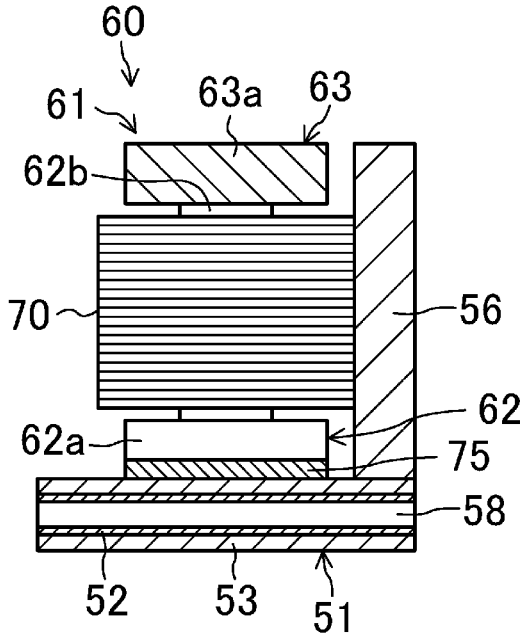
FIG. 8 is a cross-sectional view taken along the line VIII-VIII in FIG. 7.

According to a third alternative shown in FIGS. 7 and 8, a rear jacket (56) is added to the cooling member (51) of the first embodiment. The rear jacket (56) is in the shape of a slightly thick flat plate, like the lower jacket (53). The rear jacket (56) stands upright on a rear end of the lower jacket (53) (see FIG. 8). The rear jacket (56) is arranged to contact the coil (70) wound around the leg portion (62*b*) of the T-shaped core (62) to cool the coil (70). Like the lower jacket (53), the rear jacket (56) is made of metal having high thermal conductivity, and constitutes a heat transfer part.

In the third alternative, the lower jacket (53) cools the magnets (75, 75), and simultaneously, the rear jacket (56) cools the coil (70). Thus, the heat generation by the coil (70) can be reduced, and heat input from the coil (70) to the magnets (75, 75) can be reduced. Thus, the magnets (75, 75) can be cooled more effectively.

—Fourth Alternative—

Figure 9:
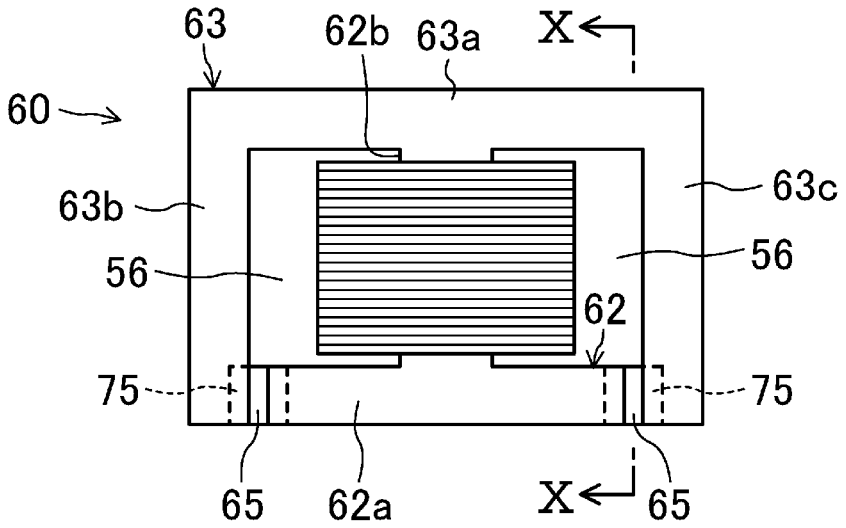
FIG. 9 is a front view of a cooling unit according to a fourth alternative of the first embodiment.
Figure 10:
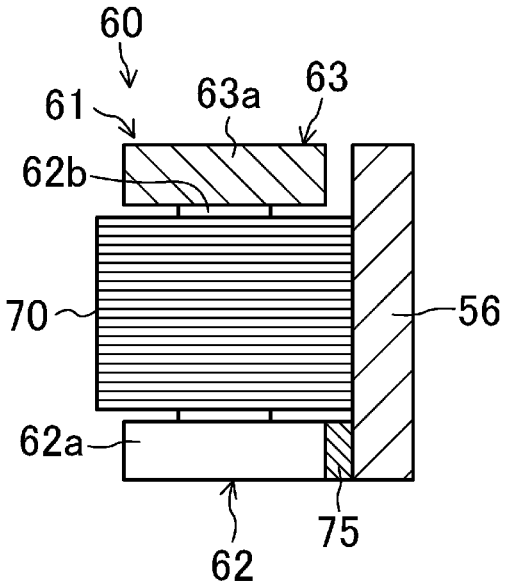
FIG. 10 is a cross-sectional view taken along the line X-X in FIG. 9.

According to a fourth alternative shown in FIGS. 9 and 10, the lower jacket (53) of the first embodiment is not provided, and the rear jacket (56) is provided in the same manner as the third alternative. In the fourth alternative, the magnets (75, 75) which are in contact with the T-shaped core (62) and the C-shaped core (63) are provided behind the core (61) (see FIG. 10). The magnets (75, 75) of the fourth alternative are in contact with the rear jacket (56). In the fourth alternative, the coil (70) and the rear jacket (56) are in contact with each other, like the third alternative. The refrigerant pipes through which the refrigerant flows are buried in the rear jacket (56) in the same manner as the first embodiment.

In the fourth alternative, the rear jacket (56) simultaneously cools the magnets (75, 75) and the coil (70). Thus, the heat generation by the coil (70) can be reduced also in the fourth alternative. This can reduce heat input from the coil (70) to the magnets (75, 75), and the magnets (75, 75) can be cooled more effectively.

[Second Embodiment of the Invention]

An air conditioner (10) according to a second embodiment includes a cooling unit (50) configured differently from that of the first embodiment. The difference between the second and first embodiments will be described below.

Figure 11:
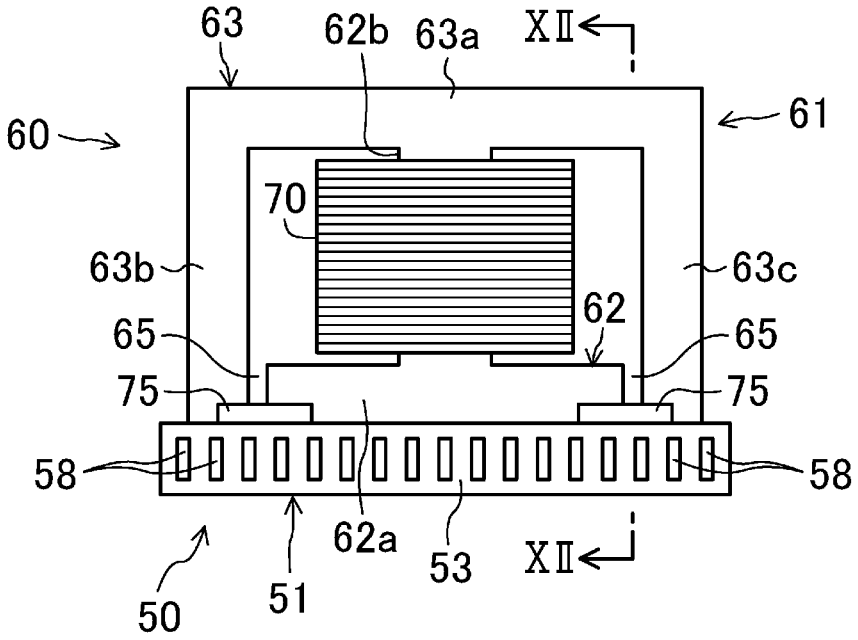
FIG. 11 is a front view of a cooling unit according to a second embodiment.
Figure 12:
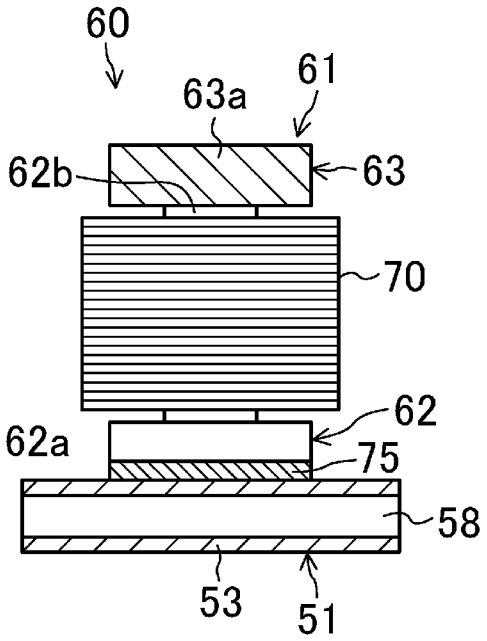
FIG. 12 is a cross-sectional view taken along the line XII-XII in FIG. 11.

In the cooling unit (50) of the second embodiment shown in FIGS. 11 and 12, a plurality of refrigerant passages (58) are formed in a lower jacket (56) as a heat transfer part. Specifically, unlike the first embodiment in which the refrigerant passages (58) are formed in the refrigerant pipes (52), the refrigerant passages (58) are directly formed in the lower jacket (56) of the second embodiment to penetrate the lower jacket.

Each of the plurality of refrigerant passages (58) has a vertically oriented rectangular cross section perpendicular to a direction of a flow of the refrigerant. The refrigerant passages (58) are arranged at regular intervals in a thickness direction thereof. In the second embodiment, the refrigerant passages (58) are arranged in almost the entire part of the lower jacket (56) to be aligned in a lengthwise direction of the lower jacket (56) (a horizontal direction in FIG. 11). The refrigerant in the refrigerant circuit (20) is divided to flow into the refrigerant passages (58) in parallel. Specifically, the refrigerant passages (58) constitute refrigerant passages parallel to each other. Each of the refrigerant passages (58) is a so-called microchannel having an extremely small cross-sectional area.

In the second embodiment, like the first embodiment described above, the refrigerant flows through the refrigerant passages (58) in the cooling and heating operations. Thus, heat of the magnets (75, 75) is transferred to the refrigerant in the refrigerant passages (58) through the lower jacket (56). This cools the magnets (75, 75). Unlike the cooling unit of the first embodiment, the cooling unit (50) of the second embodiment does not include the refrigerant pipes (58) in the lower jacket (56). Thus, the heat of the magnets (75, 75) is easily transferred to the refrigerant, and the magnets (75, 75) can be cooled effectively.

<Alternatives of Second Embodiment>

The second embodiment may be modified in the following manner.

Figure 13:
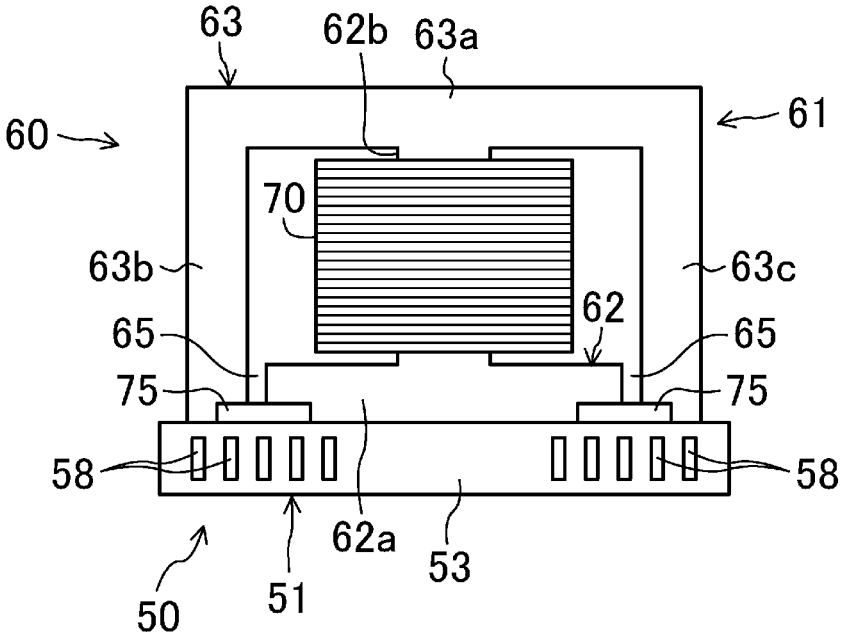
FIG. 13 is a front view of a cooling unit according to an alternative of the second embodiment.

As shown in FIG. 13, the refrigerant passages (58) may be formed only in parts of the lower jacket (56) closer to the magnets (75, 75). In this alternative, three refrigerant passages (58) are formed in each of the parts of the lower jacket (56) below the magnets (75, 75). In the alternative shown in FIG. 13, the magnets (75, 75) can efficiently be cooled even when the number of the refrigerant passages (58) is reduced.

[Other Embodiments]

The embodiments described above may be modified in the following manner

In the above embodiments, the air conditioner (10) has been used as the refrigeration apparatus for performing the refrigeration cycle. However, the refrigeration apparatus for performing the refrigeration cycle may be, for example, a heat pump-type chiller unit, a hot water supply system, or a cooling apparatus for cooling the inside of a refrigerator or a freezer.

In the above embodiments, the cooling member (51) cools the magnet-equipped reactor (60) only. The cooling member (51) may simultaneously cool the power device of the inverter apparatus (48).

In the above embodiments, the cooling refrigerant flows through the refrigerant pipe (52) in the cooling member (51). For example, the refrigerant pipe (52) may be replaced with a path through which cooling air or cooling water flows.

In the above embodiments, the cooling unit (50) is connected between the expansion valve (43) and the outdoor heat exchanger (42). However, the cooling unit (50) may be connected between the expansion valve (43) and the indoor heat exchanger (42). In this configuration, the magnet (75) can be cooled by a low pressure liquid refrigerant flowing through the refrigerant passages (58) in the cooling operation.

A parallel circuit may be connected in parallel to a main liquid line of the refrigerant circuit (21), and the refrigerant passages (58) of the cooling unit (50) may be connected to the parallel circuit. When two decompression mechanisms are provided in the parallel circuit to sandwich the cooling unit (50), a low pressure refrigerant decompressed in one of the decompression mechanisms can be sent to the refrigerant passages (58) in both of the cooling and heating operations. This configuration can surely cool the magnet (75) in both of the cooling and heating operations.

The configurations of the second embodiment and the alternative shown in FIG. 13 may be applied to the alternatives of the first embodiment.

The above-described embodiments have been set forth merely for the purposes of preferred examples in nature, and are not intended to limit the scope, applications, and use of the invention.

INDUSTRIAL APPLICABILITY

As described above, the present invention is useful for a cooling structure for a magnet-equipped reactor.

DESCRIPTION OF REFERENCE CHARACTERS

51 Cooling member
52 Refrigerant pipe
53 Lower jacket (heat transfer part)
54 Side jacket (heat transfer part)
55 Groove
56 Rear jacket (heat transfer part)
58 Refrigerant passage
60 Magnet-equipped reactor
61 Core
70 Coil
75 Magnet

The invention claimed is:

1. A cooling structure for a magnet-equipped reactor, the cooling structure comprising:

a magnet-equipped reactor having a core around which a coil is wound, and a pair of permanent magnets arranged to contact the core; and a cooling member which contacts the magnets of the magnet-equipped reactor to cool the magnet, wherein the cooling member includes a plurality of refrigerant passages through which refrigerant flows, and a plurality of grooves, each groove positioned above one of the plurality of refrigerant passages, and wherein each magnet of the pair of magnets is fitted in one of the plurality of grooves formed in the cooling member.

2. The cooling structure for the magnet-equipped reactor of claim 1, wherein the cooling member contacts both the pair of magnets and the coil wound around the core to cool both.

3. The cooling structure for the magnet-equipped reactor of claim 1, wherein the cooling member includes a heat transfer part arranged to contact the magnet to exchange heat with the refrigerant in the refrigerant passage.

4. The cooling structure for the magnet-equipped reactor of claim 3, wherein a temperature of the refrigerant flowing through a refrigerant passage is lower than a dew point temperature of air around the cooling member.

5. The cooling structure for the magnet-equipped reactor of claim 3 or 4, wherein each of the plurality of refrigerant passages is formed in a refrigerant pipe buried in the heat transfer part.

6. A cooling structure for a magnet-equipped reactor, the cooling structure comprising:

a magnet-equipped reactor having a core around which a coil is wound, and a pair of permanent magnets arranged to contact the core; and a cooling member which contacts the magnets of the magnet-equipped reactor to cool the magnets, wherein the cooling member includes a heat transfer part, and a plurality of refrigerant passages through which refrigerant flows, the plurality of refrigerant passages being form within the heat transfer part;

each magnet of the pair of magnets is disposed so as to reach a pair of opposing portions of the core sandwiching a magnet gap, such that a largest surface of each magnet is flush with a surface of the core adjacent to the cooling member and each magnet is arranged above at least one of the plurality of refrigerant passages, and a flat surface of the heat transfer portion contacts the largest surface of the magnet and the surface of the core adjacent to the cooling member.

* * * * *